US005586494A

United States Patent [19]

Simonis

[11] Patent Number: 5,586,494

[45] Date of Patent: Dec. 24, 1996

[54] SWIVELLING PISTON PRESS

[75] Inventor: Jürgen Simonis, Wolfenbüttel, Germany

[73] Assignee: Welger GmbH, Wolfenbüttel, Germany

[21] Appl. No.: 451,578

[22] Filed: May 26, 1995

[30] Foreign Application Priority Data

May 26, 1994 [DE] Germany ..... 9408619 U

[51] Int. Cl.[6] ..... B30B 9/30; B30B 1/32

[52] U.S. Cl. ..... 100/189; 100/233; 100/269.2

[58] Field of Search ..... 100/142, 179, 100/189, 233, 269.13, 269.2

[56] References Cited

U.S. PATENT DOCUMENTS

| | | | |
|---|---|---|---|
| 3,215,291 | 11/1965 | Nickla | 100/233 |
| 3,220,577 | 11/1965 | Laverne | 100/189 |
| 5,029,522 | 7/1991 | Brisson | 100/233 |
| 5,063,841 | 11/1991 | Simonis | 100/142 |
| 5,458,058 | 10/1995 | Zeronian et al. | 100/233 |

FOREIGN PATENT DOCUMENTS

| | | | |
|---|---|---|---|
| 2519931 | 10/1976 | Germany | 100/233 |
| 3722757 | 1/1989 | Germany | 100/189 |
| 1240584 | 7/1971 | United Kingdom | 100/233 |

*Primary Examiner*—Stephen F. Gerrity
*Attorney, Agent, or Firm*—Anderson, Kill, Olick P.C.

[57] ABSTRACT

A swiveling piston press, in particular for compacting waste cardboard, including an arcuate compression channel in which a compression piston is supported for pivotal movement between two positions by a hydraulic piston-cylinder unit with the piston press being designed in such a way that the piston rod is loaded in tension during the compression stroke movements of the compression piston, and in its extended position, forms an acute angle with the line connecting the pivot axis of the compression piston with the connection point of the compression piston with the piston rod.

5 Claims, 1 Drawing Sheet

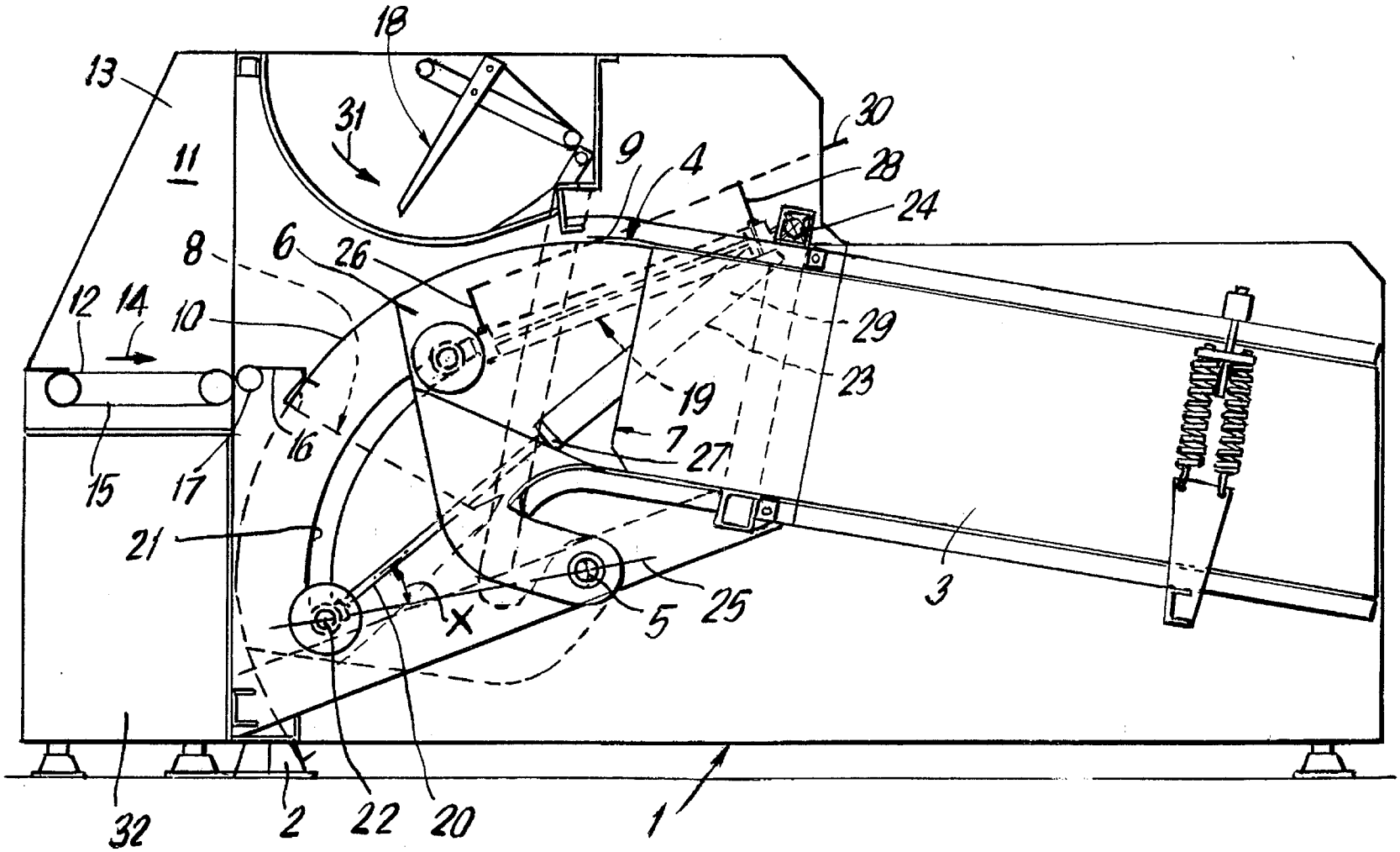
1
2
3
4
5
6
7
8
9
10
11
12
13
14
15
16
17
18
19
20
21
22
23
24
25
26
27
28
29
30
31
32

SWIVELLING PISTON PRESS

BACKGROUND OF THE INVENTION

The invention is directed to a swiveling piston press with an arcuate compression channel in which a compression piston is supported for pivot movement around the axis effected by a hydraulic piston-cylinder unit, the piston rod of which is linked to the compression piston and the cylinder of which is pivotally supported at the compression channel.

In a swiveling piston press disclosed in DE-OS 22 44 037, a hydraulically driven compression piston can be swiveled around a vertical axis. The material is to be fed manually from the top. The piston-cylinder unit is linked in such a way to the compression channel and the compression piston, that the effective length of the lever arm between the piston pin, which supports the piston rod, and the swiveling axis of the piston remains essentially unchanged during the compression stroke. Because of this layout, relatively small compression forces can only be achieved at a predetermined power requirement. In addition, the cylinder arrangement requires a relatively rigid dimensioning of the housing which defines the compression space. It is also disadvantageous that feeding is effected manually directly into the compression channel which involves danger of accidents, permits only for small throughputs, and does no longer satisfy present day desires for comfort.

A mechanically driven swiveling piston press provided with a forced feeding device is disclosed in DE-OS 39 19 434. The drawback of this press consists primarily in relatively high manufacturing costs, especially as far as the main drives are concerned, when the compression channel cross-section reaches approximately one square meter, as it has been lately required.

Accordingly, the object of the invention is a swiveling piston press having a compact construction while insuring that large volume cardboard products and other bulky products can be speedily and efficiently processed with a more effective use of power than previously.

SUMMARY OF THE INVENTION

This and other objects of the invention, which will become apparent hereinafter, are achieved by providing a piston press in which the piston rod is stressed in tension during compression stroke movements of the compression piston and, in its extended position, forms an acute angle with the line connecting the compression piston swiveling axis and the piston pin or bolt which supports the piston rod. Due to this layout, the compression piston moves slowly into the end position of the compression stroke and can therefore exert a high compression force in spite of the relatively low driving power, while moving faster during its return stroke, thus exposing the filler opening for a longer time, so that larger cardboard products can be securely processed. In addition to this, a space saving construction of the swiveling piston press is obtained due to the design of the compression piston as a thrust piston.

In a preferred embodiment of the invention, the piston cylinder unit is designed to be double acting, and a common oil line feeds both cylinder chambers for the return stroke of the compression piston. In this way it is possible to increase the return stroke speed of the compression piston in spite of the low oil volumetric flow, so that the filler opening is open as long as possible during the feeding process.

An advantageous design is achieved by connecting both cylinder chambers with one another by a connecting line, and by disposing a controllable shut-off valve in the connecting line, which valve interrupts the circulation connection of both cylinder chambers during the admission of fluid into the cylinder chamber on the piston rod side.

Due to the connecting line of both cylinder chambers, the oil flows in the course of hydraulic differential admission of oil into the hydraulic piston cylinder unit directly from the piston rod side cylinder chamber into the piston side cylinder chamber. In this way, return flow losses of the oil through the original supply conduit into the piston side cylinder chamber are avoided, in spite of using hydraulic piston cylinder units with a piston to piston rod surface ratio of 1:5, which is expedient when utilizing the piston as a thrust piston.

According to a further embodiment, the compression piston can be swiveled around a horizontal axis located beneath the compression channel, and it operates with a feeding device which conveys the material supplied from a feeding table into the compression channel through a filler opening in chronological sequence to the compression piston. As a result, a compact press is obtained which can be delivered to the installation site in the elevators of the department stores without extensive disassembly.

BRIEF DESCRIPTION OF THE DRAWINGS

The objects and features of the present invention will become more apparent, and the invention itself will be best understood from the following detailed description of the preferred embodiment when read with reference to the accompanying drawings, wherein:

Single Figure shows a longitudinal schematic view of a swivelling piston press according to the present invention.

DETAILED DESCRIPTION OF THE PREFERRED EMBODIMENT

The swivelling piston press shown in the drawing includes a housing 1 which is supported on supports 2 and defines a compression space including a rectilinear compression channel 3 and an arcuate compression channel 4. A compression piston 6, which is located in the arcuate compression channel 4, is supported for pivotal movement, about a horizontal axis 5, between an upper position 7 shown in solid lines and a lower position 8 shown in dash lines.

The upper wall 9 of the arcuate compression channel 4 has a filler opening 10 upstream of which a feeding space 11 is located. In its lower position 8, the compression piston 6 completely exposes the filler opening 10. The feeding space 11 is defined by a feeding table 12, which extends between two side walls 13 and discharges into the arcuate compression channel 4 at a location above the lower position 8 of the compression piston 6. The feeding table 12 includes a conveyor belt 15 uniformly displaceable in the direction of arrow 14. The transfer from the conveyor belt 15 to the filler opening 10 is effected via a roller 17 and a stationary platform 16 which ends shortly before the travel path of the compression piston 6. The end of the stationary platform 16 adjacent to the filler opening 10 has a chamber which forms the lower edge of the filler opening 10. The feeding device 18 is disposed above the filler opening 10. The feeding device 18 is driven in chronologic relationship to the compression piston 6.

The drive of the compression piston 6 is performed by two piston-cylinder units 19, with each, respectively being disposed externally of the respective side wall 13. A piston rod 20 is pivotally supported on the bolt 22 welded sidewise to the compression piston 6 and extending outwardly through an elongated slot 21 in the side wall 13, while the cylinder 23 is supported on a transverse beam at the rectilinear compression channel 3 by a lug 24. The arrangements is laid out in such a way that the piston rod 20 is retracted into the cylinder 23 in the upper position 7 of the compression piston 6 and forms an acute angle X, in the lower position 8 of the compression piston 6, with a line 25 connecting the axis 5 and the bolt 22. The piston-cylinder unit 19 is double acting and comprises one oil line 26 for admission of oil into the piston rod side cylinder chamber 27 (piston ring surface), and a second oil line 28 for admitting oil into the piston side cylinder chamber 29 which, if needed serves as a return line for the oil. Both oil lines 26, 28 can be coupled together by a common oil line 30 shown in dotted lines and pressurized oil can be fed simultaneously to them. The oil from the piston rod side cylinder chamber 27 flows through the piston side cylinder chamber 29, whereby the piston rod 20 is rapidly retracted in spite of the relatively small oil quantity flow. A hydraulic aggregate 32 is disposed below the feeding table 12.

The mode of operation of the swiveling piston press is as follows:

When the compression piston 6 is located in its lower position 8, the piston rod 20 is extended. The conveyor belt 15 as well as the feeding device 18 move in the direction of the arrows 14, 31 and push the waste cardboard parts which have to be compacted through the filler opening 10 into the rectilinear compression channel portion 3. After a predetermined number of strokes of the feeding device 18, pressurized oil is fed to the oil line 26. The compression piston 6 moves from its lower position 8 into its upper position 7, and oil flows from the cylinder space 29 into the oil line 28, which now serves as an oil return line. Based on the angular position of the swiveling axis 5 of the compression piston 6 and the bolt 22 of the piston rod 20, the compression piston 6 moves, when the forces are small, rapidly. When high compression forces are necessary, the compression piston 6 moves at a lower speed at the maximally effective length of the lever in the upper pressing position 6. After the piston 6 reaches the upper position 7, pressurized oil is fed to the oil line 30 so that both cylinder chambers 27, 29 are supplied with oil and at the compression piston 6 moves rapidly back into its lower position 8, and a new feeding cycle starts. When the required bale length is reached the bale is tied off in the per se known manner.

Though the present invention was shown and described with reference to the preferred embodiments, various modification thereof will be apparent to those skilled in the art and, therefore, it is not intended that the invention be limited to the disclosed embodiments and details thereof, and departure may be made therefrom within the spirit and scope of the present invention as defined in the appended claims.

What is claimed is:

1. A swivelling piston press for forming bales of material, said swivelling piston press comprising:

a housing;

compression channel means formed in said housing for receiving the material to be baled;

a compression piston supported in said compression channel means for pivotal movement about an axis into an extended position of the compression piston during a return stroke thereof for enabling feeding of the material to be baled into said compression channel means, and into a retracted position thereof during a compression stroke thereof for compressing the material received in said compression channel means to form a bale;

a piston-cylinder unit for pivoting said compression piston between the extended and retracted positions thereof and including a cylinder pivotally supported on said compression channel means and a piston rod connected to said compression piston;

wherein said piston rod is tension-stressed during the compression stroke of said compression piston and, in the retracted position of said compression piston, forms an acute angle with a connection line connecting the pivotal axis of said compression piston with a connection point of said compression piston with said piston rod.

2. A swivelling piston press as set forth in claim 1, wherein said piston-cylinder unit includes a double acting cylinder having two chambers, a piston rod side chamber and a piston side chamber, and wherein said swivelling piston press further comprises an oil conduit for supplying oil to both cylinder chambers of said cylinder for effecting the return stroke of said compression piston.

3. A swivelling piston press as set forth in claim 2, wherein said piston-cylinder unit includes a conduit connecting the two cylinder chambers, and a shut-off valve located in said connecting conduit and which interrupts a connection between the two cylinder chambers when oil is supplied to the piston rod side cylinder chamber for effecting the compression stroke of said compression piston.

4. A swivelling piston press as set forth in claim 1, wherein the pivotal axis of the compression piston extends horizontally and is located beneath said compression channel means; and wherein said swivelling piston press further comprises a feeding table and a feeding device which delivers material supplied through said feeding table into a filler opening of said compression channel means in a chronological sequence in accordance with the pivotal movement of said compression piston.

5. A swivelling piston press as set forth in claim 1, wherein said compression channel means comprises a rectilinear compression channel portion and an arcuate compression channel portion, and wherein said compression piston is displaceable in said arcurate compression channel portion.

* * * * *